US005613270A

United States Patent [19]

Alvarez et al.

[11] Patent Number: 5,613,270

[45] Date of Patent: Mar. 25, 1997

[54] MOTORLESS FLOOR WASHING MACHINE

[75] Inventors: John M. Alvarez, 175 Beulah Rd., Doylestown, Pa. 18901; David M. Alvarez, 4304 Old Bethlehem Pike, Telford, Pa. 18969

[73] Assignees: David M. Alvarez; John M. Alvarez, Doylestown, Pa.

[21] Appl. No.: 177,090

[22] Filed: Dec. 30, 1993

[51] Int. Cl.[6] ..... A47L 11/30

[52] U.S. Cl. ..... 15/320; 15/341; 15/353

[58] Field of Search ..... 15/341, 342, 343, 15/320

[56] References Cited

U.S. PATENT DOCUMENTS

| | | | |
|---|---|---|---|
| 569,644 | 10/1896 | Jacobson et al. | 15/342 |
| 784,583 | 3/1905 | Murray | 15/341 X |
| 1,037,027 | 8/1912 | Lindberg | 15/341 X |
| 1,243,516 | 10/1917 | Harris | 15/342 |
| 1,327,456 | 1/1920 | Baender . | |
| 1,605,857 | 11/1926 | Sherbondy . | |
| 1,901,519 | 3/1933 | Keith | 15/342 |
| 2,883,695 | 4/1959 | Sherbondy . | |
| 2,910,721 | 11/1959 | Burrage . | |
| 4,041,567 | 8/1977 | Burgoon . | |
| 4,094,031 | 6/1978 | Cellini . | |
| 4,282,626 | 8/1981 | Schneider . | |
| 4,295,243 | 10/1981 | King . | |
| 4,353,145 | 10/1982 | Woodford . | |
| 4,363,152 | 12/1982 | Karpanty . | |
| 4,369,544 | 1/1983 | Parisi . | |
| 4,372,700 | 2/1983 | Moffitt, Jr. . | |

*Primary Examiner*—Chris K. Moore

[57] ABSTRACT

A motorless floor washing machine comprising a frame carrying a suction pump, wheels carried by the frame for moving of the machine and actuation of the pump to suck up a liquid, a handle for moving the frame and elements carried thereby, thereby to move the wheels and actuate the pump, a recovery tank fed by the pump, and a dispenser carried by the frame for discharging a cleaning liquid in front of the pump, whereby upon manual movement of the machine and discharge of a cleaning liquid carried thereby onto a floor, the cleaning liquid cleans the floor and is thereafter sucked up by the pump.

13 Claims, 7 Drawing Sheets

MOTORLESS FLOOR WASHING MACHINE

BACKGROUND OF THE INVENTION

The classical way of washing a floor is with a mop and a bucket of soapy water. This can be upgraded by a squeegee mounted on the bucket so the mop can be squeezed out.

It works quite well but there are limits on the bucket volume and the elbow-power needed to wield the mop.

At the other end of the spectrum are electric motor driven machines which scrub and clean. While they perform well, they are expensive, bulky and limited by the length of the electric cord. In addition, it is necessary frequently to move the electric plug of the machine which, in view of the water nearby and possibly on the hands of the operator, poses potential safety risks.

It is accordingly an object of the present invention to provide a non-electric driven, motorless floor washing machine which is easy to manufacture and use and safe to use and move about.

SUMMARY OF THE INVENTION

These and other objects and advantages are realized in accordance with the present invention pursuant to which there is provided a motorless floor washing machine comprising a frame carrying a suction pump, wheels carried by said frame for moving of the machine and actuation of said pump to suck up a liquid, means for manually moving the frame and elements carried thereby, thereby to move said wheels and actuate said pump, a recovery tank fed by said pump, and means carried by said frame for discharging a cleaning liquid in front of said pump, whereby upon manual movement of said machine and discharge of a cleaning liquid carried thereby onto a floor, said cleaning liquid cleans the floor and is thereafter sucked up by the pump.

PREFERRED EMBODIMENTS

Advantageously the machine includes a squeegee carried by said frame at least partially behind the inlet to said pump, whereby the squeegee ensures that all liquid on the floor in front of it is carried forward where it is then capable of being sucked up by said pump. The squeegee is desirably approximately semicircular and adjacent its ends includes deflection wings projecting inwardly therefrom to push liquid inwardly. Means may be provided for raising said squeegee so as to be above and out of contact with said surface, for rendering said squeegee inoperative when desired, as when moving from one place to another.

In accordance with a preferred feature, the wheels for actuation of said pump are connected by an axle including an eccentric portion, said eccentric portion being operatively connected with said pump, whereby rotation of said wheels actuates said pump to remove liquid in front of said squeegee.

The means for discharging a cleaning liquid comprises a cleaning liquid container, a laterally extending manifold having an opening for flow of liquid; and a handle permitting flow of cleaning liquid from said container to said manifold, and thereby to the surface on which said machine moves. Advantageously the opening comprises a plurality of holes along said manifold, the machine further including at least one brush behind said manifold laterally to distribute the liquid leaving said manifold.

There may also be provided abrading means carried by said frame so as to contact the surface over which said machine moves, said abrading means being located between said manifold and said squeegee.

In addition, there may be carried by said frame means for storing the liquid sucked up by said pump, and filter means between said recovery tank and said means for discharging a cleaning liquid, liquid sucked up into said recovery tank feeding by gravity into said cleaning liquid discharging means, used cleaning liquid sucked up by said pump being filtered by said filter means and then entering said means for discharging cleaning liquid.

The apparatus advantageously also includes a hose operatively connected at one end with said means for discharging a cleaning liquid, the other end of said hose being removably carried by said frame at an elevation above said cleaning liquid discharging means, lowering of said other end of said hose permitting emptying of said means for discharging a cleaning liquid.

Desirably the wheels carried by said frame for actuation of said pump comprises two spaced wheels, the machine including a third wheel in front of said two spaced wheels for supporting the machine in predetermined relationship to a floor therebelow.

BRIEF DESCRIPTION OF THE DRAWINGS

The invention will be further described with reference to the accompanying drawings, wherein.

DETAILED DESCRIPTION OF THE INVENTION

Figure 1:
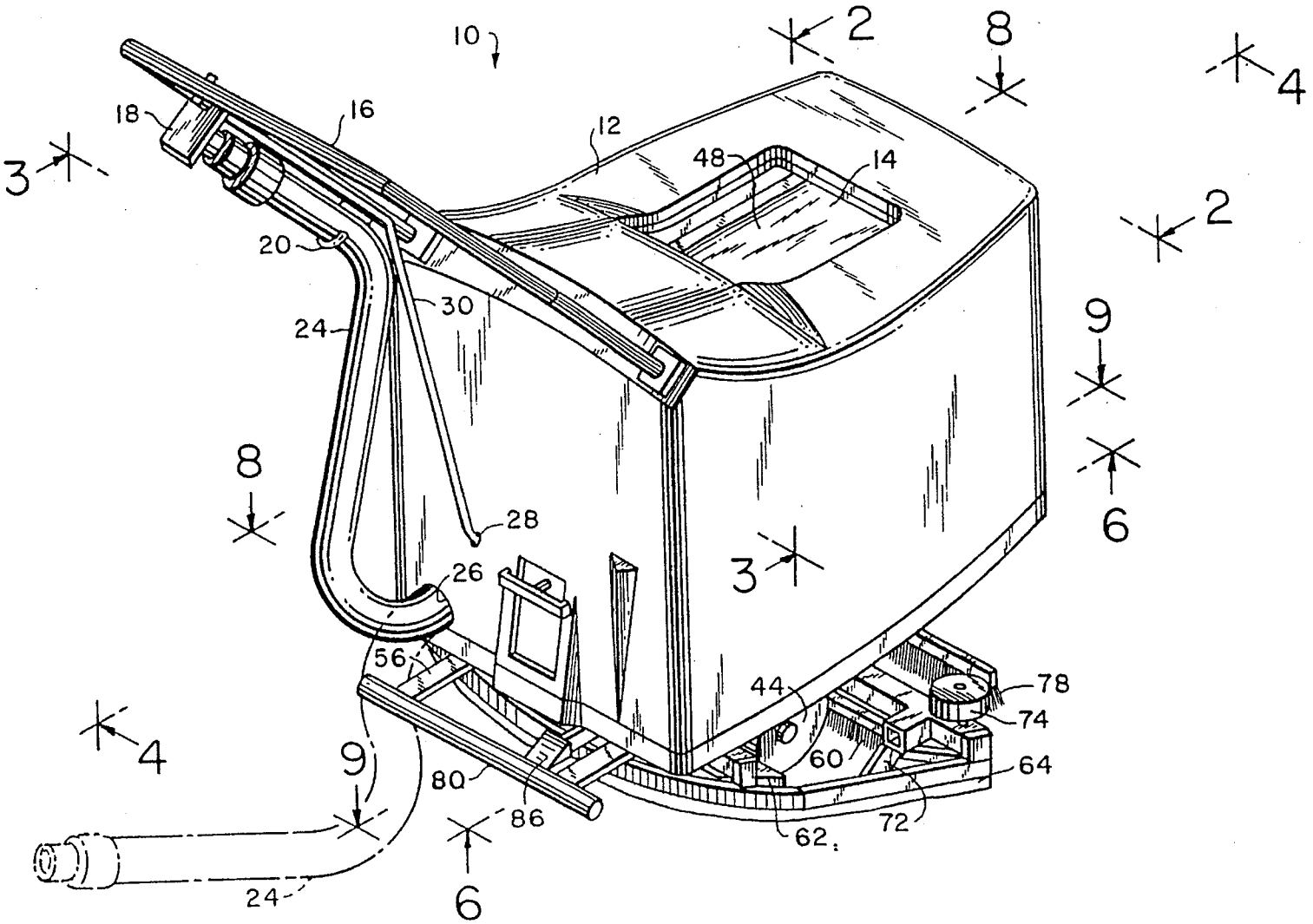
FIG. 1 is a perspective view of a floor washing machine in accordance with the present invention.

Referring now more particularly to the drawings, the machine 10 comprises a housing 12 of molded plastic or metal, having a top opening 14. From the top rear of the housing 12 there extends diagonally upward a U-shaped pusher-puller bar 16. On one leg of bar 16 there are carried a securing cap 18, a supporting hook 20 and a cleaning solution control lever 22.

A hose 24 removably fits over and is closed by the downward projection on the bottom of cap 18. The hose is guided by hook 20 and enters housing 12 through an opening 26.

Figure 3:
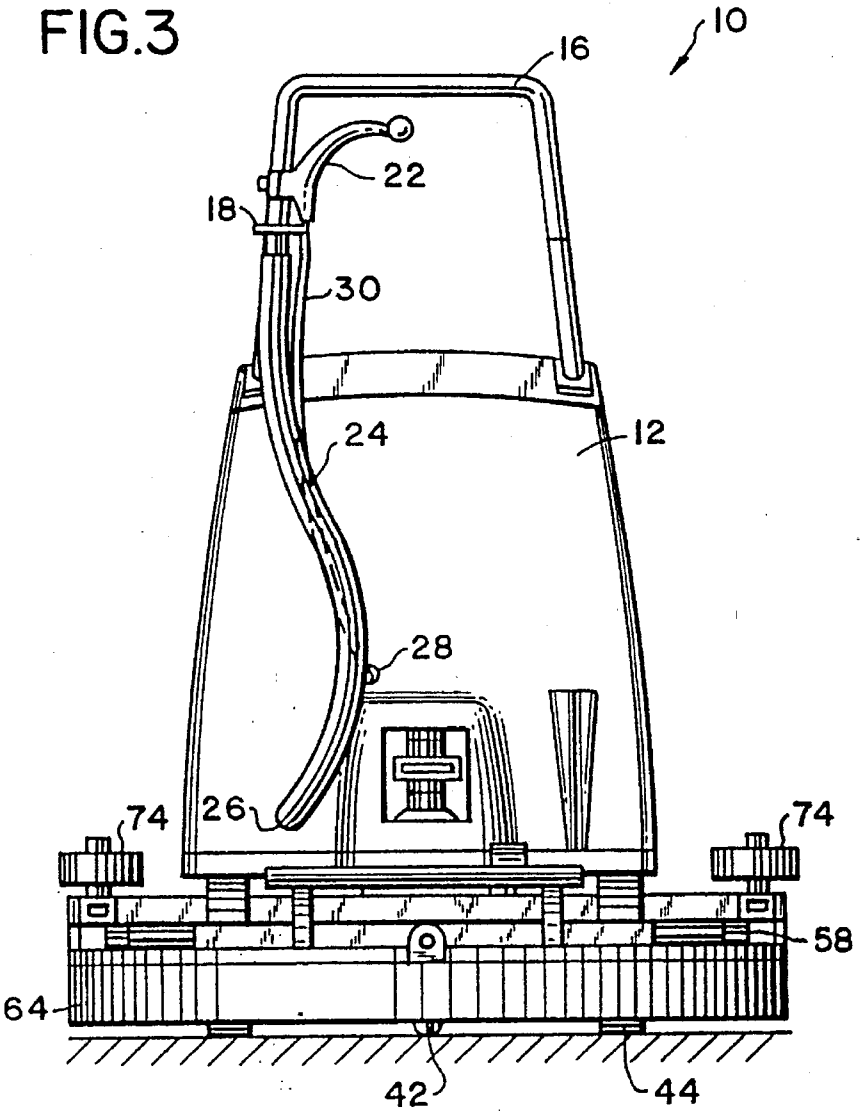
FIG. 3 is a rear view of the machine.
Figure 2:
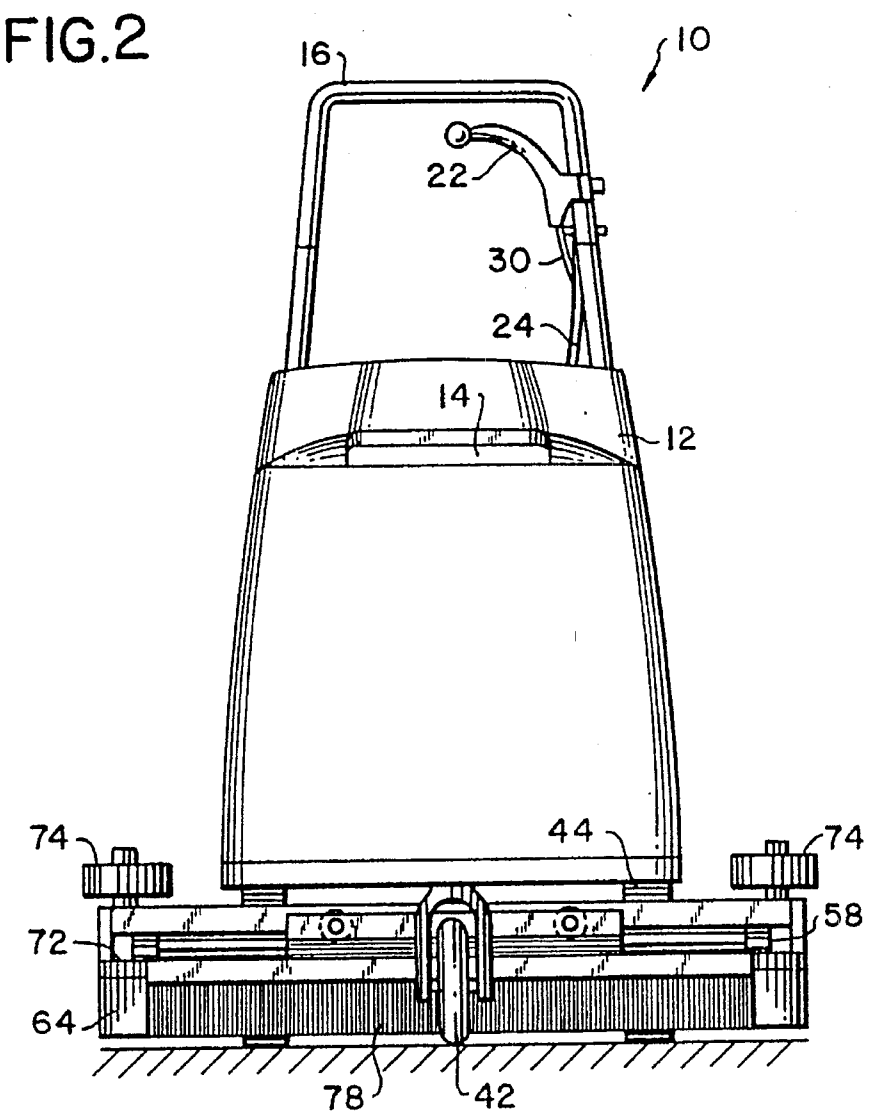
FIG. 2 is a front view of the machine.

The housing 12 has an additional opening 28 through which a cleaning solution control cable 30 extends, the top of the cable 30 being connected to solution control lever 22 (FIGS. 2 and 3).

Pull bar 18 and a removable flat lever 20 are shown. Pull bar 18 extends into the housing 12 through an opening 22 and lever 20 removably caps a hose 24 which extends into housing 12 through an opening 26. The housing has an additional opening 28 through which the shaft of a pull bar 16 extends.

Figure 4:
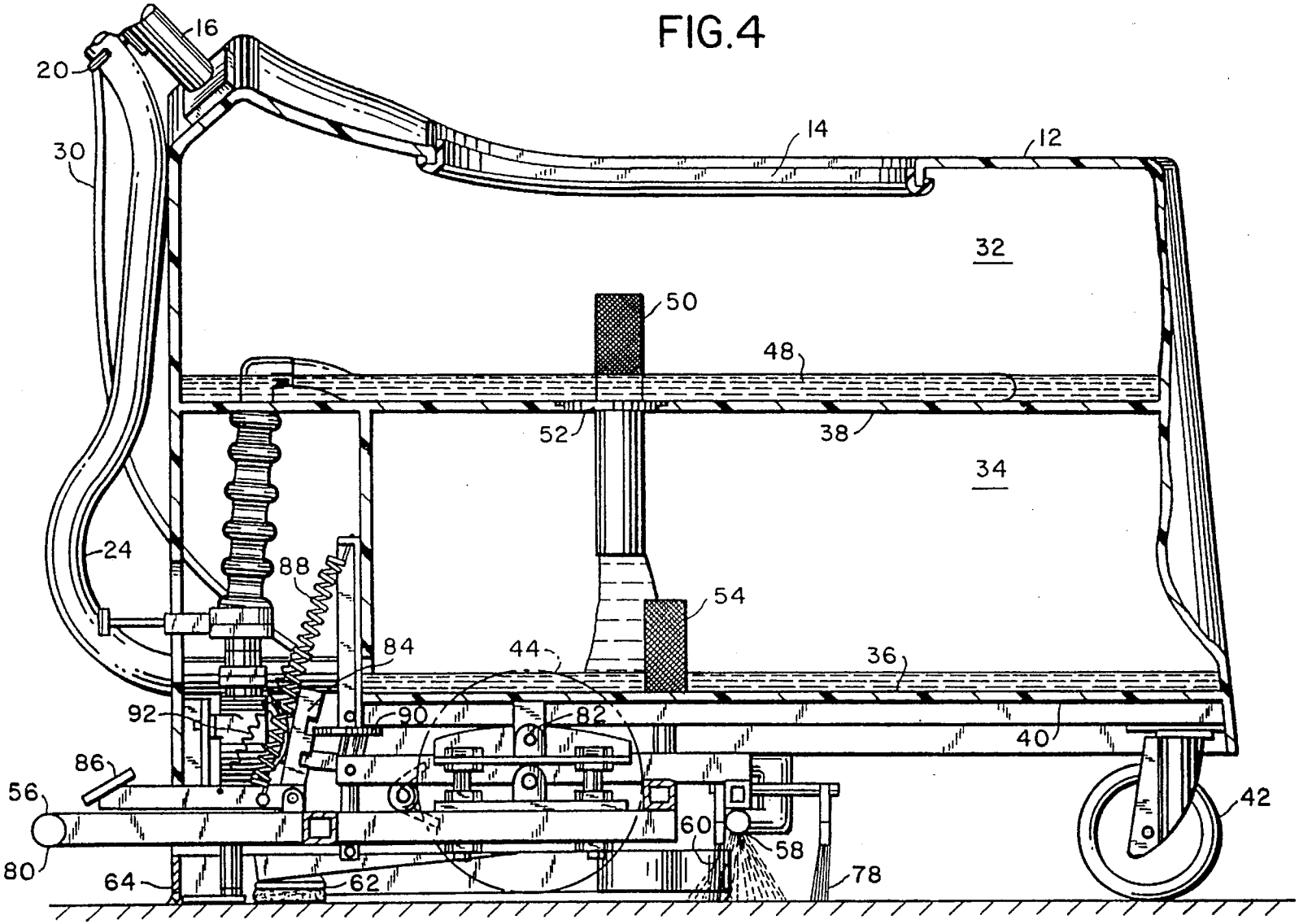
FIG. 4 is a sectional view on line 4—4 of FIG. 1.

As seen best in FIG. 4, the inside of the housing 12 is divided into an upper chamber 32 and a lower chamber 34 by base floor 36 and upper floor 38. Base floor 36 sits on a metal base frame 40 from which there depend front wheel 42 and a pair of rear wheels 44, which serve for movement under the impetus of bar 16 on the housing 12.

As will be discussed more fully hereinbelow, cleaning solution is introduced into upper chamber 32 through opening 14, the cleaning solution resting on floor 38. From there it flows into a pipe 50 which, through an opening 52 in floor 38, empties into lower chamber 34. A second filter 54 filters cleaning solution passing out of the housing 12 in a manner to be described.

At the end of use, the operator removes hose 24 from those elements holding it in raised position, puts the hose into a low position and lets the liquid in lower chamber 34 drain out through the hose 24. Optionally, after cleaning the hose is restored to initial position.

Figure 6:
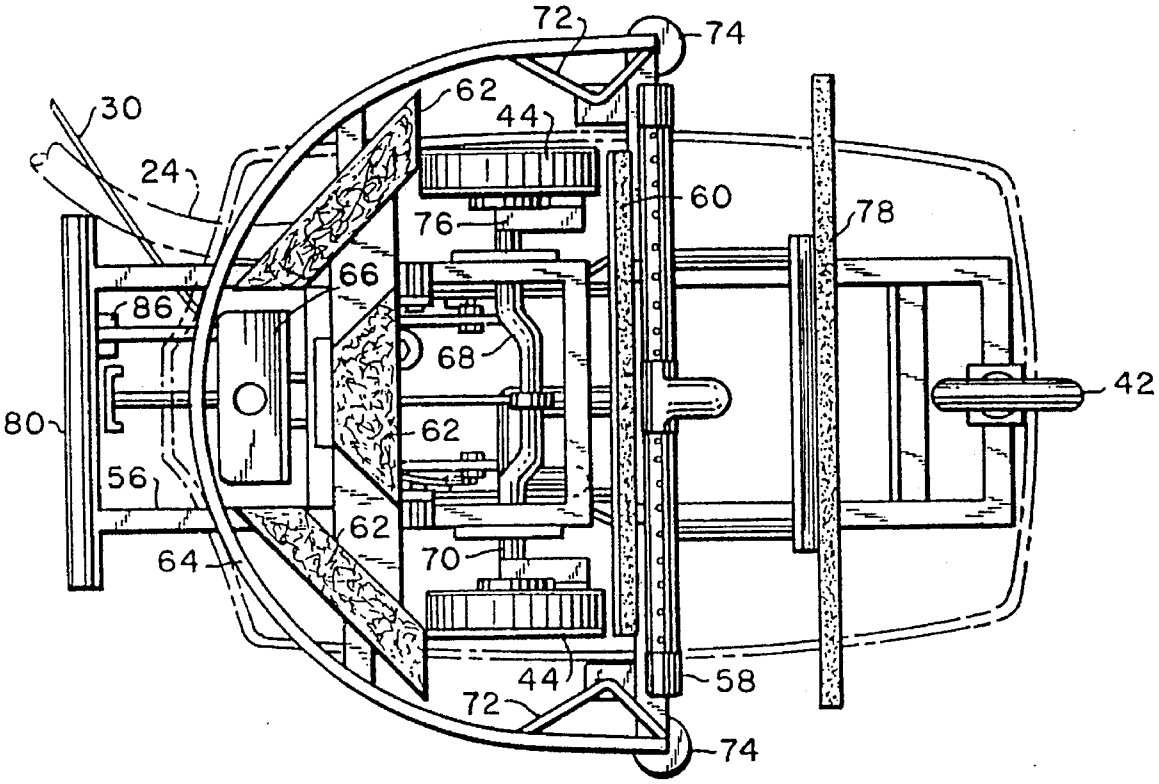
FIG. 6 is a bottom view, looking upward.
Figure 8:
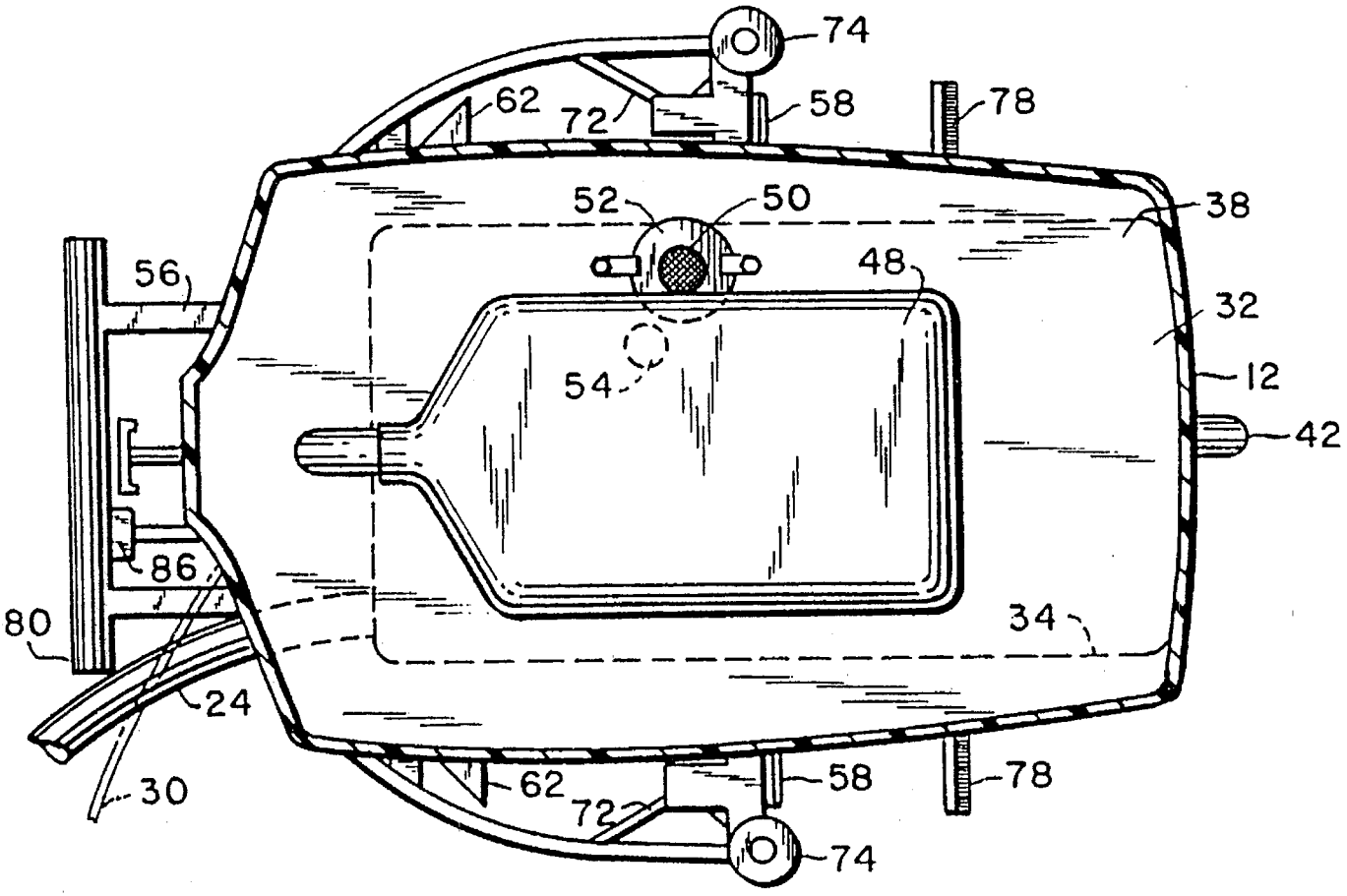
FIG. 8 is a top view.

As best seen in FIG. 6, by depressing bar 56 to a final position, cleaning solution on the floor of chamber 34 is dispersed through pipe 58 across the width of the machine. Brush 60 extends transversely of the machine and brushes the solution on the floor, spreading it out evenly.

The spread liquid is abraded by pads 62 thereby effecting cleaning and a semi-circular squeegee 64, resting on the floor, assists in cleaning and also forms the liquid into a controlled puddle which is sucked up by a pump 66 which is driven by the eccentric portion 68 of an axle 70 extending between wheels 44.

Deflection wings 72 at both ends of the squeegee 64 assist in controlling the puddle when changing direction of the machine. Rollers 74 carried near the ends of the squeegee 64 serve to protect walls from damage.

A ratcheting device 76 (FIG. 9) carried on axle 70 permits reverse movement of the entire device, without actuation of the pump 66.

Figure 9:
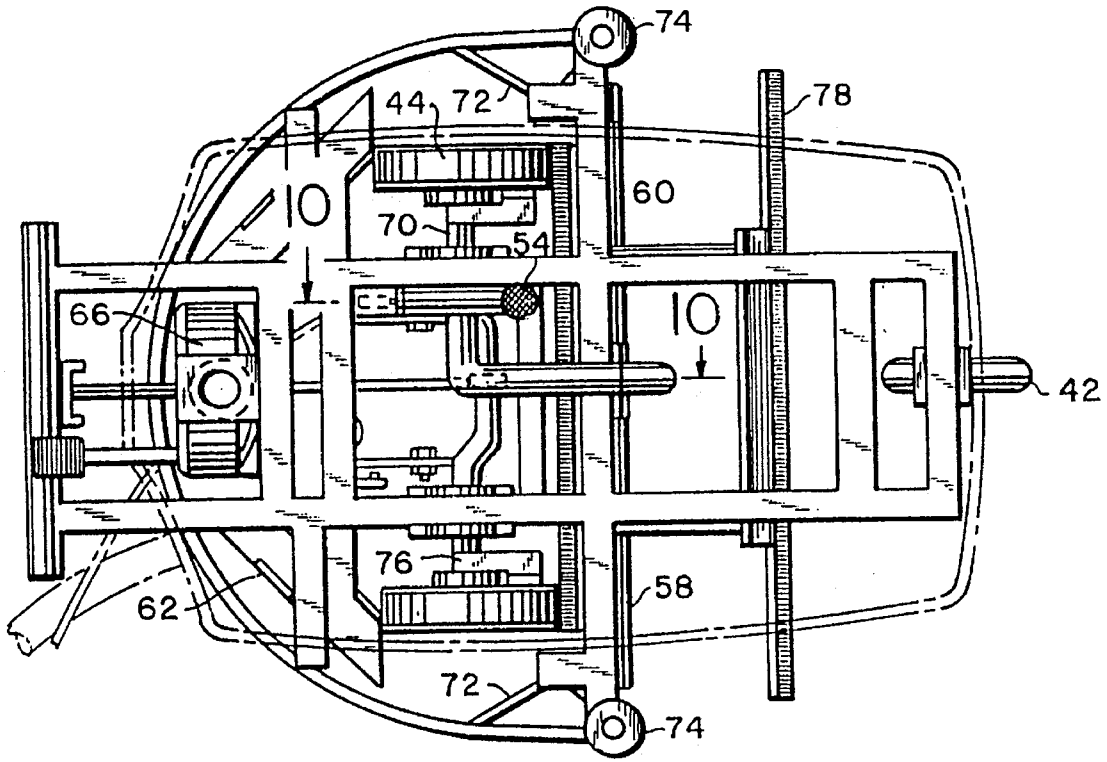
FIG. 9 is a top view without housing 12, i.e. with the housing being shown only in phantom.

As seen in FIGS. 6 and 9, to the frame 40 there is affixed a debris-catching brush 78 which sweeps debris forward so as to prevent debris from causing streaks and lines by contact with the squeegee 64.

The pump 66, actuated by forward motion of the machine, creates suction to raise the liquid constituting the puddle in front of the squeegee, the sucked up liquid being discharged from the pump 66, into the filter bay 48 in tank 32. The filtered liquid in tank 32 then percolates downward as heretofore described.

Figure 5:
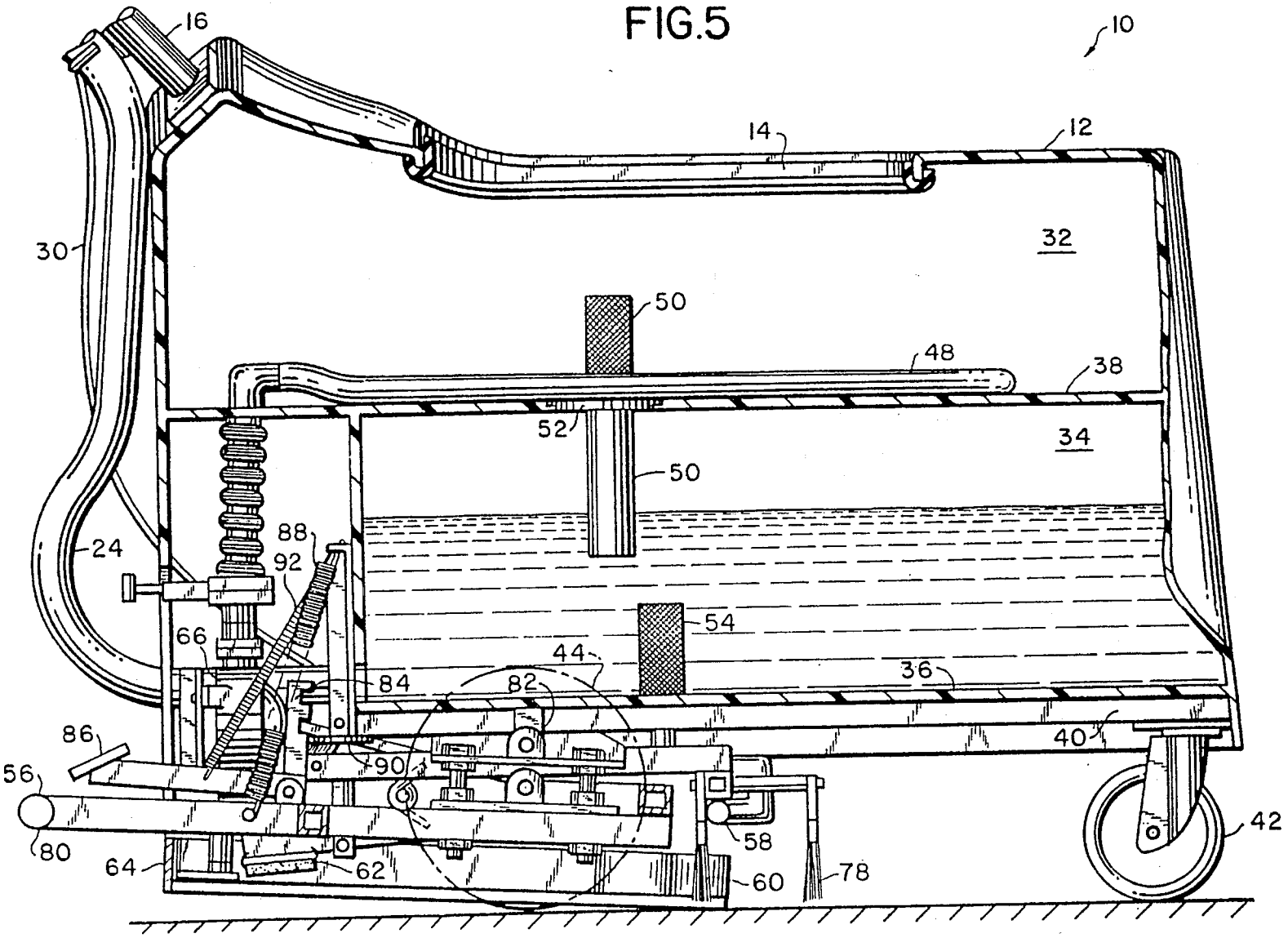
FIG. 5 is a sectional view similar to FIG. 4 but in non-operational mode.
Figure 7C:
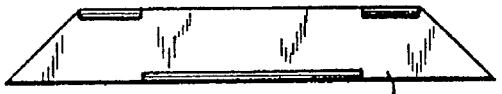
FIG. 7C is a top view of the abrading means of FIG. 7A.
Figure 7B:
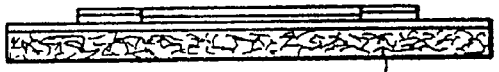
FIG. 7B is a side view of the abrading means of FIG. 7A.
Figure 7A:
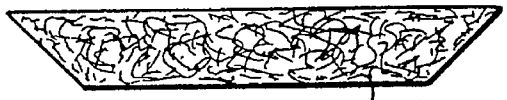
FIG. 7A is a bottom view looking up, of the abrading means of FIG. 6.

FIG. 4 shows the base frame 56 in operational position, FIG. 5 in non-operation position, i.e. with the squeegee and related elements raised off the floor, suitable for transport.

Actuating bar 80 of frame 56 is pivoted on fulcrum 82 and is held in depressed position (FIG. 4) by ratchet 84 which is releasable by pedal 86 which allows spring 88 to bring it to the position shown in FIG. 5. Ratchet 84 is held against positioning plate 90 by spring 92.

In FIG. 4 ratchet 84 is shown in final position, everything depressed relative to FIG. 5. However, ratchet 84 has additional notching which permits the frame 56 to be adjusted vertically to apply different extents of pressure of the squeegee against the floor, from no pressure to maximum. The no-pressure position permits the abrading means to operate without squeegee.

Figure 10:
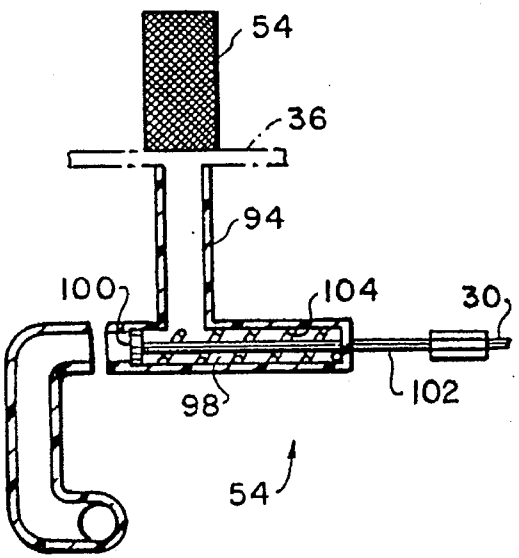
FIG. 10 is a sectional view of means, shown in FIGS. 4 and 9, for controlling the discharge of cleaning solution.

In FIG. 10, there is shown the detail of item 54 of FIG. 4. The structure comprises a non-corrosive housing 94 having a top screen 96 through which liquid passes from chamber 34 to manifold 58. In FIG. 10, the device is in closed, non-flow position. Valve chamber 98 is closed by disk 100. By pulling rod 102 to the right disk 100 is also moved to the right against the pull of spring 104, opening the liquid flow path. Rod 102 is actuated by lever 22 the movement of which is transferred through cable 30 which is connected to rod 102.

The device operates as follows:

The upper chamber 32 is filled through opening 14 with cleaning solution which percolates down through the filter device 50 to the lower chamber 34 and then percolates through filter 96 into valve assembly 54, as detailed in FIG. 10.

The operator actuates lever 22 which allows free flow of liquid through valve assembly 54 into manifold 58. Liquid is distributed evenly by brush 60, debris having first been collected by brush 78. The liquid wets the floor and abrading devices 62 operate on the floor. The spent liquid is gathered or puddled by squeegee 64 so that pump 66 can suck it up and discharge it though filter bag 48 into upper chamber 32.

The filtered liquid recirculates by gravity though screen 50 entering lower chamber 34, where it is discharged as heretofore described.

When terminating operation or it is desired to provide new cleaning solution, drain hose 24 is lowered to permit draining of spent liquid.

It is possible to operate the abrading means without collection of the spent liquid, thereby saturating the surface and allowing deeper cleaning, followed by pick up of liquid in a later pass.

It will be appreciated that the instant specification and the claims are set forth by way of illustration and not limitation, and that various modifications and changes may be made without departing from the spirit and scope of the present invention.

We claim:

1. A motorless floor washing machine comprising a frame carrying a suction pump having an inlet and discharge outlet, wheels carried by said frame for moving of the machine and actuation of said pump to suck up a liquid, means for manually moving the frame and elements carried thereby, thereby to move said wheels and actuate said pump, a recovery tank fed by said pump from the pump outlet, and means carried by said frame for discharging a cleaning liquid in front of said pump, whereby upon manual movement of said machine and discharge of a cleaning liquid carried thereby onto a floor, said cleaning liquid cleans the floor and is thereafter sucked up by the pump through its inlet to be discharged through its outlet.

2. A machine according to claim 1, including a squeegee carried by said frame at least partially behind the inlet to said pump, whereby the squeegee ensures that all liquid on the floor in front of it is carried forward where it is then capable of being sucked up by said pump.

3. A machine according to claim 2, wherein the wheels for actuation of said pump are connected by an axle including an eccentric portion, said eccentric portion being operatively connected with said pump, whereby rotation of said wheels actuates said pump to remove liquid in front of said squeegee.

4. A machine according to claim 2, including means for raising said squeegee so as to be above and out of contact with said surface.

5. A machine according to claim 2, wherein said squeegee is approximately semi-circular.

6. A machine according to claim 5, including deflection wings adjacent the ends of said squeegee and projecting inwardly therefrom.

7. A machine according to claim 1, wherein said means for discharging a cleaning liquid comprises a cleaning liquid container, a laterally extending manifold having an opening for flow of liquid; and a means permitting flow of cleaning liquid from said container to said manifold, and thereby to the surface on which said machine moves.

8. A machine according to claim 7, wherein said opening comprises a plurality of holes along said manifold, the machine further including at least one brush behind said manifold laterally to distribute the liquid leaving said manifold.

9. A machine according to claim 7, further including abrading means carried by said frame so as to contact the surface over which said machine moves, said abrading means being located between said manifold and said squeegee.

10. A machine according to claim 1, including means carried by said frame for storing the liquid sucked up by said pump.

11. A machine according to claim 10, including filter means between said recovery tank and said means for discharging a cleaning liquid, sucked up liquid in said recovery tank feeding by gravity into said cleaning liquid discharging means, used cleaning liquid sucked up by said pump being filtered by said filter means and then entering said means for discharging cleaning liquid.

12. A machine according to claim 1, including a hose operatively connected at one end with said means for discharging a cleaning liquid, the other end of said hose being removably carried by said frame at an elevation above said cleaning liquid discharging means, lowering of said other end of said hose permitting emptying of said means for discharging a cleaning liquid.

13. A machine according to claim 1, wherein said wheels carried by said frame for actuation of said pump comprises two spaced wheels, the machine including a third wheel in front of said two spaced wheels for supporting the machine in predetermined relationship to a floor therebelow.

* * * * *